United States Patent [19]

Muramatsu et al.

[11] 3,988,158

[45] Oct. 26, 1976

[54] PROCESS FOR ANTISTATIC TREATMENT OF LIGHT-SENSITIVE SILVER HALIDE PHOTOGRAPHIC MATERIAL

[75] Inventors: Toshio Muramatsu; Koichi Nagayasu; Masayuki Kimura; Sadatugu Terada; Masayoshi Mayama, all of Hino, Japan

[73] Assignee: Konishiroku Photo Industry Co., Inc., Tokyo, Japan

[22] Filed: Oct. 6, 1975

[21] Appl. No.: 620,137

[30] Foreign Application Priority Data

Oct. 7, 1974 Japan ..... 49.115853

[52] U.S. Cl. ..... 96/87 A; 260/DIG. 17; 260/DIG. 18; 260/DIG. 20; 252/500; 96/114.2; 252/321

[51] Int. Cl.[2] ..... G03C 1/78; H01B 1/00

[58] Field of Search ..... 96/87 A, 114.2; 260/DIG. 17, DIG. 18, DIG. 19, DIG. 20; 252/500

[56] References Cited

UNITED STATES PATENTS

| | | | |
|---|---|---|---|
| 3,538,053 | 11/1970 | Rembaum et al. | 260/67 R |
| 3,821,176 | 6/1974 | Arend et al. | 260/DIG. 19 |
| 3,828,008 | 8/1974 | Shinohara et al. | 252/500 |

*Primary Examiner*—John D. Welsh

*Attorney, Agent, or Firm*—Haseltine, Lake & Waters

[57] ABSTRACT

Antistatic and antifoaming agents for use with light sensitive silver halide photographic materials comprised of polymerized pyridyl-type compounds are disclosed.

3 Claims, No Drawings

PROCESS FOR ANTISTATIC TREATMENT OF LIGHT-SENSITIVE SILVER HALIDE PHOTOGRAPHIC MATERIAL

This invention relates to a process for the antistatic treatment of a light-sensitive silver halide photographic material.

A light-sensitive silver halide photographic material is essentially composed of a plastic film as support and a photosensitive silver halide emulsion layer formed on one or both sides of said support. Generally, however, the plastic film is liable to be statically charged due to abrasion or peeling to cause dust adhesion, electric shock, ignition and the like drawbacks. For example, at the time of preparing a light-sensitive silver halide photographic material, the plastic film is charged with static electricity due to abrasion with or peeling from other substances during various steps such as rolling-up, rolling-back, coating of various layers including photosensitive layers, and transportation at the time of drying, and when said electricity is discharged, the silver halide photographic material coated with photosensitive layer will, after exposure and development, come to have unevenly sensitized portions called static marks due to irregular static electricity. Further, if the silver halide photographic material thus prepared is statically charged when it is used or processed, static marks are formed as well, and many disadvantages derived from adhesion of dust or the like are brought about. The formation of static marks tends to become more marked because of such recent trends that not only light-sensitive silver halide photographic materials have been increased in sensitivity but also there are many such opportunities that they are subjected to severe mechanical treatments due to the automatic rapid processing carried out at present.

In order to prevent light-sensitive silver halide photographic materials from static charge, there has heretofore been adopted, for example, such procedure that various compounds are coated on the surfaces of plastic films, which are supports, or on the surfaces of silver halide emulsion layers, so that the plastic films are reduced in surface resistivity and thus are freed from or decreased in property of being charged with static electricity. However, it is the actual state that most of these compounds are degraded in antistatic effect with time, or even if the compounds are more or less satisfactory in antistatic effect in the case where the supports for silver halide photographic materials are plastic films, they give undesirable influence to the photosensitive layers to deteriorate the photographic materials in properties, and thus cannot sufficiently accomplish the purpose of application thereof.

An object of the present invention is to provide a novel and effective process for preventing light-sensitive silver halide photographic materials from static charge which, even when applied to light-sensitive silver halide photographic materials, gives no detrimental effect to the photographic properties of the photographic materials.

According to a preferred embodiment of the present invention, a polymer of the later-mentioned general formula according to the present invention is incorporated into a layer constituting a light-sensitive silver halide photographic material, preferably into the outermost layer thereof, whereby static charge generated at the time of preparation of the photographic material can effectively be prevented. Particularly when the polymer according to the present invention is applied to a light-sensitive silver halide photographic material, the surface resistivity of the photographic material can be reduced more stably to time and humidity than in the case where the conventional antistatic agent is used. The polymer according to the present invention, which has such effect as mentioned above, is far more excellent in efficiency than the known compound of this kind.

According to another embodiment of the present invention, the polymer according to the present invention is incorporated into a light-sensitive silver halide photographic material, whereby foams formed on the surfaces of processing solutions at the time of processing of the photographic material can effectively be inhibited.

It is well known that various surface active agents are used in light-sensitive silver halide photographic materials. When such silver halide photographic materials are subjected to development, said surface active agents flow out and accumulate in the processing solutions, with the result that various disadvantages are frequently brought about. For example, in a laboratory, such treatments as development, stopping, film-hardening, bleaching and fixing, or a combination of said treatments, are carried out continuously in most cases over a long period of time while supplying replenish solutions, and if the processing solution is vigorously stirred, the solution forms a large number of foams to bring about such great operational drawbacks as migration of the processing solution into the adjacent bath, incomplete removal of floating foreign matters by overflow, etc. Further, when the foams adhere to the surface of photosensitive emulsion layer of light-sensitive photographic material, uneven development, incomplete fixing and incomplete stopping take place to form unevenly processed portions. As a measure to overcome such drawbacks as above, there is ordinarily adopted such procedure that defoaming agents are incorporated into processing solutions or light-sensitive silver halide photographic materials.

Defoaming substances which have been known hitherto include many compounds of the silicone, polyglycol and polyether types. Generally, however, defoaming substances which are excellent in defoaming effects are insoluble or sparingly soluble in water in most cases, and hence cannot uniformly disperse when incorporated into processing solutions using water as solvent. Accordingly, the defoaming substances adhere to the surfaces of photosensitive emulsion layers, or agglomerate and precipitate in the processing solutions, with the result that they are degraded in defoaming effect to make it difficult to sufficiently prevent the formation of unevenly processed portions and stains or the change in photographic properties. Although there are some water-soluble defoaming agents, they should be incorporated in considerably large amounts into processing solutions or light-sensitive silver halide photographic materials in order to attain sufficient defoaming effects, and hence are liable to deteriorate the photographic properties of light-sensitive silver halide photographic materials processed with such processing solutions and to give undesirable influence to the silver halide photographic materials by forming dregs on the films or by making the processing solutions turbid. Thus, the defoaming substances available at present cannot sufficiently give desired effects.

According to the present invention, it is also possible to overcome such drawbacks of this kind of high molecular weight defoaming agents as formation of dregs, turbidity of processing solutions and adhesion of dregs onto the films due to processing. Particularly, a polymer having a —CO— group in the molecule has effect of preventing the processing solutions from turbidity.

It is therefore another object of the present invention to provide a novel process for preventing light-sensitive silver halide photographic materials from static charge without forming foams in the processing solutions or without making the processing solution turbid at the time of processing.

As the result of extensive studies, we have found that polymers having a structure represented by the general formula shown below have characteristics that are effective to accomplish the above-mentioned objects.

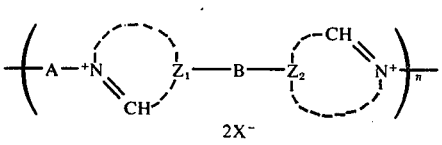

wherein A is an alkylene, alkenylene, arylene, aralkylene or arylenealkylene group having 2 to 18 carbon atoms, or a group of the formula $—R_1COR_2—$, $—R_3COR_4COR_5—$, $-R_6-(OR_7)_m-$, $—R_8COOR_9OCOR_{10}—$, $—R_{11}OCONHR_{12}NHCOOR_{13}—$ or $—R_{14}CONHR_{15}NHCOR_{16}—$; B is a simple bond, or a group selected from $—NHCOR_{17}CONH—$ and A (where $R_1$ to $R_{17}$ are individually an alkylene group having 1 to 10 carbon atoms or a phenylene group, and m is an integer of 1 to 4); $Z_1$ and $Z_2$ are individually a non-metallic atom grouping necessary to form a 5- or 6-membered ring together with the —N=CH— group (or may bond to B in the form of the quaternary salt

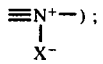

$X^-$ is an anion; and *n* is a positive integer.

That is, the objects of the present invention can be accomplished by applying at least one member selected from polymers having the aforesaid general formula to a light-sensitive silver halide photographic material.

Typical examples of the polymers having the aforesaid general formula are as enumerated below, but polymers usable in the present invention are not limited to these.

(1)

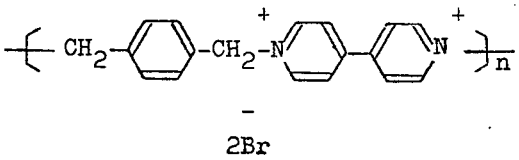

(2)

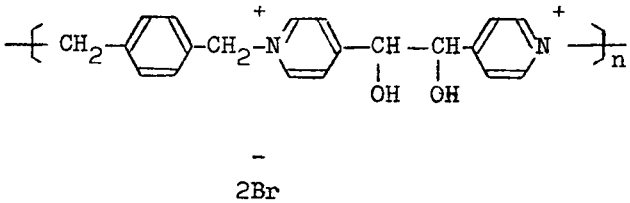

(3)

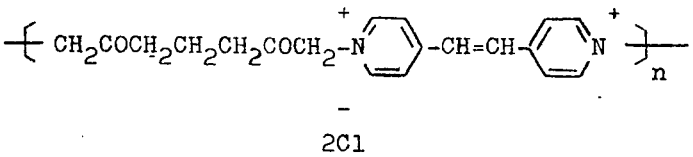

(4)

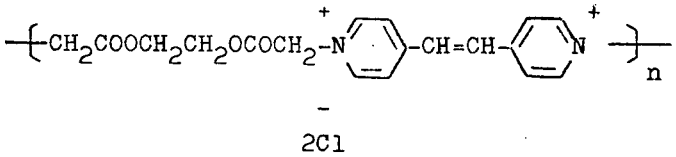

(5)

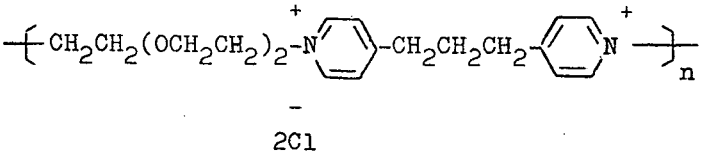

(6) 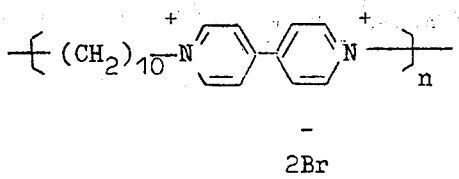
(7) 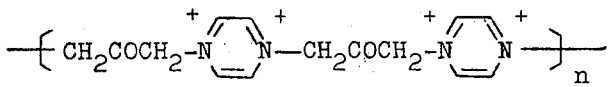
(8) 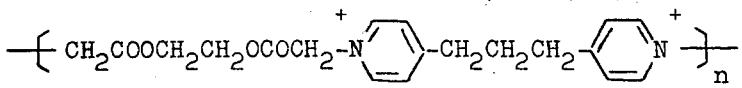
(9) 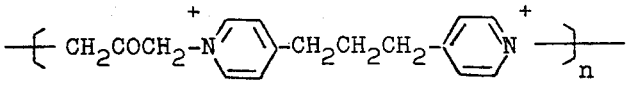
(10) 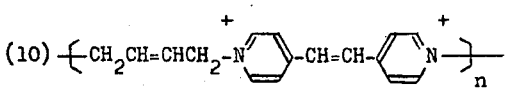
(11) 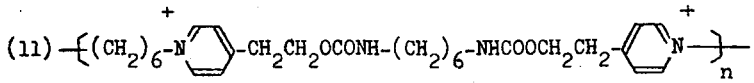
(12) 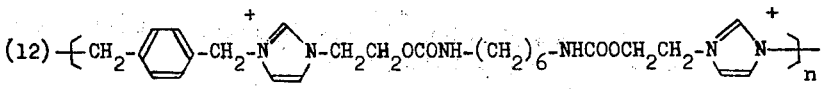
(13) 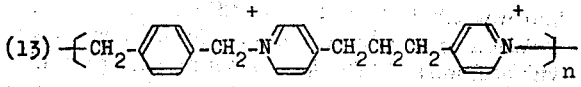

(14) 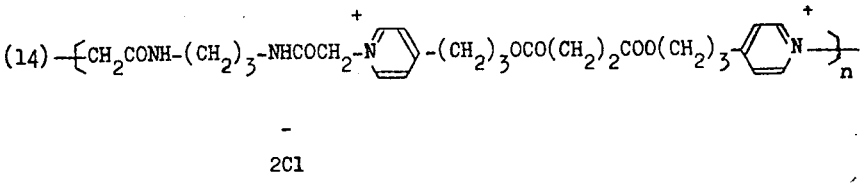

(15) 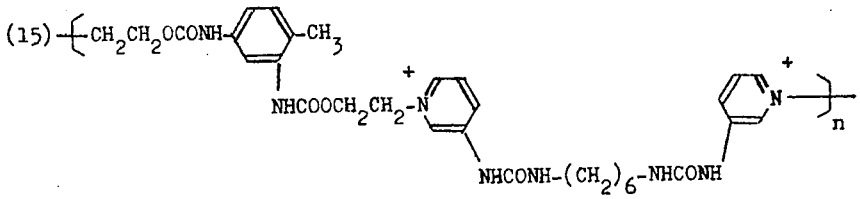

(16) 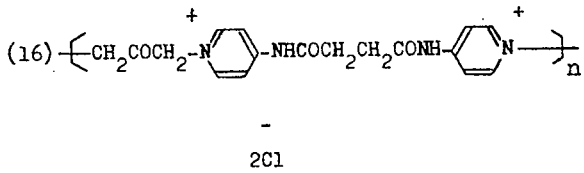

(17) 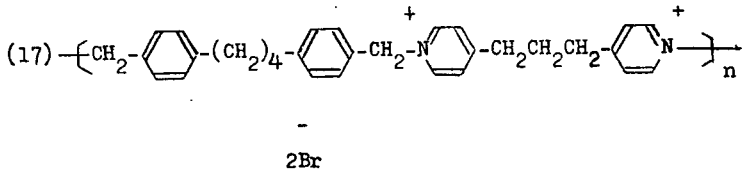

The above-mentioned polymers according to the present invention can be synthesized by, for example, successively subjecting a bifunctional halide and a bifunctional tertiary amine to Menshutkin reaction, and polymerizing them by polymerization accompanying quaternarization. In this case, the terminal groups of the resulting polymer are either tertiary amines or halogen atoms. A polymer increased in molecular weight, as a polycation having a side chain in part, which is prepared by partly adding a polyfunctional amine such as 2,4,6-tris(dimethylaminomethyl)phenol, is also useful in the present invention. However, the aforesaid polymer preferable for use in the present invention has a specific viscosity ($\eta$ *sp*) of 0.001 to 0.5 as measured by use of an Ostwald's viscometer under the conditions shown in the Synthesis Examples described below.

Typical procedures for synthesizing the above-mentioned polymers are described below with reference to Synthesis Examples.

SYNTHESIS EXAMPLE 1

Synthesis of the exemplified polymer (2):

A mixture comprising 54 g. of $\alpha,\beta$-di-(4-pyridyl)-glycol and 62 g. of p-xylylene bromide was dissolved in 500 ml. of N,N-dimethylformamide. The resulting solution was allowed to react at 70° C. for 25 hours to deposit a solid. After separation, the solid was washed with acetone and then dried under reduced pressure to obtain 113 g. of the desired polymer. The specific viscosity ($\eta$ *sp*) in 0.1 M saline water (25.0° ± 0.2° C.) of the thus obtained polymer at a concentration of 0.5% was 0.0073.

Elementary analysis for ($C_{20}H_{20}N_2O_2Br_2$):

| | C | H | N | Br |
|---|---|---|---|---|
| Calculated (%) | 50.02 | 4.20 | 5.83 | 33.28 |
| Found (%) | 49.83 | 4.52 | 5.67 | 33.05 |

SYNTHESIS EXAMPLE 2

Synthesis of the exemplified polymer (6):

A mixture comprising 15 g. of 1,10-dibromodecane and 7.8 g. of γ,γ-dipyridyl was dissolved in 50 ml. of N,N-dimethylformamide. The resulting solution was allowed to react at 60° C. for 20 hours to deposit a solid. After separation, the deposit was washed with acetone and then dried under reduced pressure to obtain 21.5 g. of the desired polymer. The specific viscosity ($\eta$ *sp*) of the thus obtained polymer was 0.0285 as measured under the same conditions as in Synthesis Example 1.

Elementary analysis for $(C_{20}H_{28}N_2Br_2)_n$:

| | C | H | N | Br |
|---|---|---|---|---|
| Calculated (%) | 52.64 | 6.18 | 6.14 | 34.99 |
| Found (%) | 52.29 | 6.45 | 6.01 | 34.81 |

SYNTHESIS EXAMPLE 3

Synthesis of the exemplified polymer (8):

A mixture comprising 21.5 g. of bis(chloroacetyl-)ethylene glycol and 19.8 g. of 1,3-di-4-pyridylpropane was dissolved in 150 ml. of methanol. The resulting solution was allowed to react at 60° C. for 20 hours and then concentrated under reduced pressure, and the concentrate was poured into 200 ml. of ether to deposit a precipitate. After separation, the precipitate was washed with acetone and then dried under reduced pressure to obtain 40.3 g. of the desired polymer. The specific viscosity ($\eta$ *sp*) of the thus obtained polymer was 0.0524 as measured under the same conditions as in Synthesis Example 1.

Elementary analysis for $(C_{19}H_{22}N_2O_4Cl_2)_n$:

| | C | H | N | Cl |
|---|---|---|---|---|
| Calculated (%) | 55.21 | 5.36 | 6.78 | 17.16 |
| Found (%) | 54.95 | 5.67 | 6.58 | 16.88 |

SYNTHESIS EXAMPLE 4

Synthesis of the exemplified polymer (9):

A mixture comprising 12.7 g. of 1,3-dichloroacetone and 19.8 g. of 1,3-di-(4-pyridyl)-propane was dissolved in 100 ml. of methanol. The resulting solution was allowed to react at 60° C. for 20 hours and then concentrated under reduced pressure, and the concentrate was poured into 200 ml. of ether to deposit a precipitate. After separation, the precipitate was washed with acetone and then dried under reduced pressure to obtain 32.2 g. of the desired polymer. The specific viscosity ($\eta$ *sp*) of the thus obtained polymer was 0.0684 as measured under the same conditions as in Synthesis Example 1.

Elementary analysis for $(C_{16}H_{18}N_2OCl_2)_n$:

| | C | H | N | Cl |
|---|---|---|---|---|
| Calculated (%) | 59.08 | 5.58 | 8.62 | 21.80 |
| Found (%) | 58.84 | 5.90 | 8.39 | 21.46 |

SYNTHESIS EXAMPLE 5

Synthesis of the exemplified polymer (12):

A mixture comprising 22.4 g. of 1-(β-hydroxyethyl)-imidazole and 16.8 g. of 1,6-hexamethylene diisocyanate was allowed to react at 100° C. for 8 hours in 200 ml. of dry toluene, and then concentrated under reduced pressure. The concentrate was poured into 200 ml. of N,N-dimethylformamide and successively mixed with 17.5 g. of p-xylylene chloride. The resulting mixture was further reacted at 70° C. for 20 hours and then concentrated under reduced pressure, and the concentrate was poured into 200 ml. of ether to deposit a precipitate. After separation, the precipitate was washed with acetone and then dried under reduced pressure to obtain 51.3 g. of the desired polymer. The specific viscosity ($\eta$ *sp*) of the thus obtained polymer was 0.0025 as measured under the same conditions as in Synthesis Example 1.

Elementary analysis for $(C_{26}H_{36}N_6O_4Cl_2)_n$:

| | C | H | N | Cl |
|---|---|---|---|---|
| Calculated (%) | 55.02 | 6.39 | 14.81 | 12.49 |
| Found (%) | 54.85 | 6.81 | 14.22 | 12.01 |

SYNTHESIS EXAMPLE 6

Synthesis of the exemplified polymer (14):

A mixture comprising 22.7 g. of 1,3-di-N,N′-chloroacetyl aminopropane and 35.6 g. of di-4-pyridylpropyl succinate was allowed to react at 60° C. for 25 hours in 500 ml. of N,N-dimethylformamide and then concentrated under reduced pressure, and the concentrate was poured into 300 ml. of ether to deposit a precipitate. After separation, the deposit was washed with acetone and then dried under reduced pressure to obtain 52.2 g. of the desired polymer. The specific viscosity ($\eta$ *sp*) of the thus obtained polymer was 0.0132 as measured under the same conditions as in Synthesis Example 1.

Elementary analysis for $(C_{27}H_{36}N_4O_6Cl_2)_n$:

| | C | H | N | Cl |
|---|---|---|---|---|
| Calculated (%) | 55.57 | 6.22 | 9.60 | 12.15 |
| Found (%) | 55.21 | 6.55 | 9.28 | 11.91 |

SYNTHESIS EXAMPLE 7

Synthesis of the exemplified polymer (16):

A mixture comprising 12.7 g. of 1,3-dichloroacetone and 27 g. of N,N′-4-pyridyl succinic acid amide was dissolved in 200 ml. of N,N-dimethylformamide. The resulting solution was allowed to react at 60° C. for 20 hours and then concentrated under reduced pressure, and the concentrate was poured into 200 ml. of ether to deposit a precipitate. After separation, the precipitate was washed with acetone and then dried under reduced pressure to obtain 39.5 g. of the desired polymer. The specific viscosity ($\eta$ *sp*) of the thus obtained polymer was 0.0087 as measured under the same conditions as in Synthesis Example 1.

Elementary analysis for $(C_{17}H_{18}N_4O_3Cl_2)_n$:

| | C | H | N | Cl |
|---|---|---|---|---|
| Calculated (%) | 51.40 | 4.57 | 14.10 | 17.85 |
| Found (%) | 51.06 | 4.90 | 13.97 | 17.47 |

property to a plastic film. Particularly, a polymer having as the anions fluoroalkyl-containing carboxylic or sulfonic groups is effective. Alternatively, a solution of the polymer wherein the aforesaid anion coexists can also be used to attain the effect aimed at by the present invention.

Thus, various polymers can be synthesized according to the above-mentioned synthesis procedures. The elementary analysis values of the exemplified polymers, and the specific viscosities ($\eta$ *sp*) thereof as measured at a concentration of 0.5% in 0.1 molar saline water (25.0° ± 0.2° C.), are as shown in the table below.

Elementary analysis

| Exemplified Polymers | Calculated (%) C | H | N | X | Found (%) C | H | N | X | Viscosity ($\eta$ sp) (0.5 wt %/0.1N NaCl aq.) |
|---|---|---|---|---|---|---|---|---|---|
| (1) | 51.45 | 3.84 | 6.67 | x=Br 38.04 | 50.95 | 3.92 | 6.73 | 38.40 | 0.0382 |
| (2) | 50.02 | 4.20 | 5.83 | x=Br 33.28 | 49.83 | 4.52 | 5.67 | 33.05 | 0.0073 |
| (3) | 60.16 | 5.32 | 7.39 | x=Cl 18.70 | 59.83 | 5.44 | 7.12 | 18.62 | 0.0123 |
| (4) | 54.42 | 4.57 | 7.05 | x=Cl 17.85 | 54.10 | 4.72 | 6.93 | 17.72 | 0.0221 |
| (5) | 59.22 | 6.80 | 7.27 | x=Cl 18.40 | 59.08 | 6.95 | 7.03 | 18.33 | 0.0515 |
| (6) | 52.64 | 6.18 | 6.14 | x=Br 34.99 | 52.29 | 6.45 | 6.01 | 34.81 | 0.0285 |
| (7) | 40.60 | 3.89 | 13.53 | x=Cl 34.25 | 40.37 | 3.98 | 13.23 | 34.04 | 0.0071 |
| (8) | 55.21 | 5.36 | 6.78 | x=Cl 17.16 | 54.95 | 5.67 | 6.58 | 16.88 | 0.0524 |
| (9) | 59.08 | 5.58 | 8.62 | x=Cl 21.80 | 58.84 | 5.90 | 8.39 | 21.46 | 0.0684 |
| (10) | 62.55 | 5.25 | 9.12 | x=Cl 23.08 | 62.28 | 5.50 | 8.98 | 23.24 | 0.0152 |
| (11) | 59.04 | 7.43 | 9.84 | x=Cl 12.45 | 59.00 | 7.62 | 9.57 | 12.17 | 0.0111 |
| (12) | 55.02 | 6.39 | 14.81 | x=Cl 12.49 | 54.85 | 6.81 | 14.22 | 12.01 | 0.0025 |
| (13) | 67.56 | 5.94 | 7.51 | x=Cl 18.99 | 67.38 | 6.02 | 7.34 | 19.26 | 0.1852 |
| (14) | 55.57 | 6.22 | 9.60 | x=Cl 12.15 | 55.21 | 6.55 | 9.28 | 11.91 | 0.0132 |
| (15) | 47.70 | 5.17 | 14.36 | x=Br 20.48 | 47.52 | 5.39 | 14.11 | 20.65 | 0.0127 |
| (16) | 51.40 | 4.57 | 14.10 | x=Cl 17.85 | 51.06 | 4.90 | 13.97 | 17.47 | 0.0087 |
| (17) | 62.63 | 5.77 | 4.71 | x=Br 26.89 | 62.39 | 5.99 | 4.50 | 27.12 | 0.1525 |

SYNTHESIS EXAMPLE 8

A mixture comprising 12.7 g. of 1,3-dichloroacetone, 19.8 g. of 1,3-di-(4-pyridyl)-propane and 0.265 g. of 2,4,6-tris(dimethylaminomethyl)-phenol was dissolved in 200 ml. of N,N-dimethylformamide. The resulting solution was allowed to react at 60° C. for 20 hours to deposit a solid. After separation, the solid was washed with acetone and then dried under reduced pressure to obtain 32.5 g. of a polymer having a specific viscosity ($\eta$ *sp*) of 0.2365. This polymer, which was prepared by adding a small amount of a trifunctional amine as the third component at the time of synthesis of the exemplified polymer (2), is far higher in molecular weight than the exemplified polymer (2).

In the present invention, it is also effective to use polymers having side chains in part which are prepared by use of, for example, a polyfunctional amine such as 2,4,6-tris(dimethylaminomethyl)-phenol. The present invention further includes the use of the said polymers.

As the polymer used in the present invention, one having halogen ions as the anions is easily synthesizable. Further, the halogen ions may be easily substituted by other organic or inorganic anions, and a polymer having such anions can also impart excellent antistatic In the present invention, the application of polymers having the aforesaid general formula to light-sensitive silver halide photographic materials is most simply effected in such a manner that one or two or more of the polymers are dissolved in a proper solvent, e.g. water or an organic solvent or a mixture of these, to prepare a solution having a concentration of about 0.01 to 10%, and then the solution is applied to the surface of a light-sensitive silver halide photographic material. For the application, there may be adopted any of such procedures as, for example, coating, spraying and dipping. The amount of the polymer applied varies depending on the kind of the plastic, which is the support, and the kind and uses of the silver halide photographic material employed. Generally, however, the polymer is applied in an amount of 3 to 300 mg. per $m^2$ of the silver halide photographic material, whereby a sufficient antistatic effect can be attained.

Alternatively, the polymers can be applied in such a manner that one or two or more of the polymers are dissolved or dispersed in a suitable binder such as polyvinyl alcohol or gelatin, and the resulting solution or dispersion is coated on the plastic film, which is the support, or on the photographic coating layer of a light-sensitive silver halide photographic material, thereby forming a layer thereon. Layers containing these polymers can, if necessary, be incorporated with other cationic polymers, plasticizers, antioxidants, matting agents and the like additives which are required according to the kinds and use purposes of light-sensitive silver halide photographic materials.

The term "application" referred to in the present invention signifies not only to coat and adhere the polymer onto the surface of the plastic film, which is the support of a light-sensitive silver halide photographic material, but also to coat and adhere the polymer onto any surface of a light-sensitive silver halide photographic material. That is, the light-sensitive silver halide photographic material referred to in the present invention includes not only finished light-sensitive silver halide photographic materials but also any intermediary products during the preparation of light-sensitive silver halide photographic materials.

Ordinarily, a sub layer is formed on a plastic film used as the support of a light-sensitive photographic material in order to adhere a photosensitive layer onto the surface thereof. When the polymer according to the present invention is adhered onto the surface of the thus formed sub layer, the plastic film can sufficiently be prevented from static charge. Typical examples of such sub layer include layers of saponification products of plastic substrates, layers of maleic anhydride-vinyl acetate copolymers, and layers of vinylidene chloride copolymers.

Generally, a light-sensitive silver halide photographic material has on the surface of the support thereof a photosensitive silver halide emulsion layer, an inter layer, a protective layer, a backing layer and the like, and it is also possible to apply the polymer according to the present invention onto the outer-most layer of the light-sensitive photographic material having said layers. Typical examples of the said backing layer include layers of polyvinyl acetals, layers of copolymers containing vinylidene chloride, layers of cellulose esters, and layers composed of mixtures of said compounds. The polymer according to the present invention can, of course, be incorporated into any of the said layers.

As mentioned above, the polymer according to the present invention is applied either directly or indirectly through a proper layer to the surface of a light-sensitive silver halide photographic material, whereby the photographic material can be made antistatic. If necessary, various layers may further be formed on the surface of photographic material to which has been applied the polymer according to the present invention. Examples of such layers include protective layers, matting layers containing particles of silicon oxide or the like, and layers containing anionic materials or fluorine-containing compounds.

Examples of plastic films as the supports of light-sensitive silver halide photographic materials to which the present invention is applicable include cellulose triacetate films, polyethylene terephthalate and the like polyester films, polycarbonate films, polystyrene films and polyolefin films. Further, the plastic films as the supports include supports for optional silver halide photographic materials such as, for example, supports for printing papers which have been prepared by laminating the aforesaid plastic films.

A light-sensitive silver halide photographic material, to which the present invention has been applied, not only has such prominent antistatic property as mentioned above, but is not deteriorated in photographic properties. Further, when the polymer according to the present invention is incorporated into the outer-most layer, e.g. protective or backing layer, of a light-sensitive photographic material, or is coated on the surface of said layer, a small amount of the polymer dissolves out in the photographic processing solutions at the time of processing of the photographic material, whereby not only the processing solutions can effectively be inhibited from formation of foams due to surface active agents or the like, but also it becomes possible to overcome such drawbacks as formation of dregs in the processing solutions or turbidity of the processing solutions.

Even when incorporated into any photographic coating layer of a light-sensitive silver halide photographic material, the polymer according to the present invention can effectively prevent the photographic material from static charge, as mentioned previously. However, in order to sufficiently display both defoaming effect and antistatic effect, the polymer is desirably incorporated into the outer-most layer, e.g. protective or backing layer, of the photographic material.

Light-sensitive materials, to which the present invention is applicable, include not only black-white and color negative films, reversal positive films, printing papers and the like light-sensitive materials which are processed according to ordinary processing procedures, but also various light-sensitive materials which are processed according to diffusion transfer method, direct reversal method, silver dye bleaching method, stabilization method, etc.

The antistatic and defoaming abilities of the polymers used in the present invention are explained in detail below with reference to Test Example and Examples. Test Example To each of a color film developer of the below-mentioned prescription (I) and a stop-fixer of the below-mentioned prescription (II) was added each of a surface active agent A (sodium dodecylbenzenesulfonate) and a surface active agent B (butylphenoxy polyethylene glycol sulfonic acid) which were used as compounds corresponding to foaming surface active agents dissolving out of light-sensitive photographic materials.

| Prescription (I): | |
|---|---|
| Water | 800 ml. |
| Benzyl alcohol | 3.8 ml. |
| Sodium hexametaphosphate | 2.0 g. |
| Sodium sulfite (anhydrate) | 2.0 g. |
| Sodium carbonate (monohydrate) | 50.0 g. |
| Potassium bromide | 1.0 g. |
| Sodium hydroxide (10 % aqueous solution) | 5.5 ml. |
| 4-Amino-3-methyl-N-ethyl-N-(methylsulfonamidoethyl) aniline 3/2 $H_2SO_4$ monohydrate | 5.0 g. |
| Water to make | 1 liter |

| Prescription (II): | |
|---|---|
| Water | 600 ml. |
| Sodium thiosulfate (pentahydrate) | 100 g. |
| Sodium sulfite (anhydrate) | 10 g. |
| Glacial acetic acid | 20 ml. |
| Potassium alum | 10 g. |
| Sodium hydroxide | 7.5 g. |
| Water to make | 1 liter |

The resulting mixtures were individually incorporated with each of such defoaming agents as the exemplified polymers (2), (6) and (8), a control polymer A [polytrimethyl(vinyloxymethyl)ammonium-p-toluenesulfonate; average molecular weight 50,000] and a control polymer B [poly-4-vinyl-N-acetonitrile pyridinium bromide; average molecular weight 30,000] to prepare 8 samples of the prescriptions shown in Table 1.

Table 1

| Prescription \ Sample No. | 1 | 2 | 3 | 4 | 5 | 6 | 7 | 8 |
|---|---|---|---|---|---|---|---|---|
| Prescription (I) | 1 liter | 1 liter | 1 liter | 1 liter | 1 liter | — | — | — |
| Prescription (II) | — | — | — | — | — | 1 liter | 1 liter | 1 liter |
| Surface active agent A (1 % aqueous solution) | 0.5 ml. | 0.5 ml. | 0.5 ml. | 1.5 ml. | 1.5 ml. | — | — | — |
| Surface active agent B (1 % aqueous solution) | — | — | — | — | — | 3 ml. | 3 ml. | 3 ml. |
| Defoaming agent (1 % aqueous solution) | — | Exemplified polymer (2) 0.1 ml. | Control polymer A 0.5 ml. | — | Exemplified polymer (6) 0.5 ml. | — | Exemplified polymer (8) 1 ml. | Control polymer B 1 ml. |

Each of the thus prepared samples was measured in foaming degree according to shaking method carried out in such a manner that 20 ml. of the sample was tightly closed in a test tube having an inner diameter of 20 mm. whose inner surface had been cleaned, was subjected to 25 cm. vertical movements of 30 times per 10 seconds, and was measured in average height of foams formed after 10, 30, 60 and 120 seconds. The results obtained were as shown in Table 2.

Table 2

| Sample | Foaming by shaking (sec.) 10 sec. Average height | 30 sec. Average height | 60 sec. Average height | 120 sec. Average height |
|---|---|---|---|---|
| No. | of foams | of foams | of foams | of foams |
| 1 | 20 mm. | 14 mm. | 12 mm. | 12 mm. |
| 2 | 0 mm. | — | — | — |
| 3 | 12 mm. | 10 mm. | 9 mm. | 8 mm. |
| 4 | 33 mm. | 33 mm. | 30 mm. | 29 mm. |
| 5 | 0 mm. | — | — | — |
| 6 | 25 mm. | 21 mm. | 18 mm. | 17 mm. |
| 7 | 0 mm. | — | — | — |
| 8 | 10 mm. | 8 mm. | 7 mm. | 7 mm. |

As is clear from Table 2, the samples incorporated with the exemplified polymers (2), (6) and (8) are low in foaming degree, and the foams formed in said samples disappear quite rapidly. Furthermore, no dregs are formed on the surfaces of said samples. The samples incorporated with the control polymers A and B also show defoaming effects, but are lower in said effect than the samples incorporated with the exemplified polymers of the present invention, and dregs are formed on the surfaces of said samples and on the walls of test tubes.

The above-mentioned test was repeated, except that the exemplified polymers (6) and (8) were replaced by the exemplified polymers (3) and (9), to obtain the same effects as above. In addition, the sample solutions did not became turbid.

EXAMPLE 1

0.3 Gram of each of such cationic antistatic agents as shown in Table 3 was dissolved in a mixed solvent comprising 70 ml. of methanol and 30 ml. of acetone. The resulting solution was coated on a cellulose triacetate film and then dried to prepare an antistatic cellulose triacetate film.

Each of the thus prepared samples were sufficiently moistened to 55% RH and 20% RH at 25° C., and then measured in specific surface resistivity. The results obtained were as shown in Table 3.

Table 3

| Sample | Antistatic agent used | Specific surface resistivity (Ω) 55 % RH | 20 % RH |
|---|---|---|---|
| a | Quaternary salt of poly-4-vinylpyridine chloroacetone | $5 \times 10^9$ | $6 \times 10^{11}$ |
| b | Polyvinylbenzyl trimethylammonium chloride | $3 \times 10^8$ | $4 \times 10^{10}$ |
| c | Quaternary salt of polydiethylaminoethyl methacrylate with dimethylsulfuric acid | $8 \times 10^8$ | $9 \times 10^{11}$ |
| d | Exemplified polymer (2) | $4 \times 10^8$ | $2 \times 10^9$ |
| e | Exemplified polymer (8) | $8 \times 10^8$ | $5 \times 10^9$ |
| f | Exemplified polymer (12) | $3 \times 10^{10}$ | $4 \times 10^{11}$ |
| g | Exemplified polymer (14) | $5 \times 10^9$ | $3 \times 10^{10}$ |

From Table 3, it is understood that the specific surface resistivities of the samples *d*, *e*, *f* and *g*, which have been treated with the polymers according to the present invention, are far lower in dependability on humidity than those of the control samples *a*, *b* and *c*.

EXAMPLE 2

To a solution of 5 g. of the exemplified polymer (2) in 350 ml. of methanol was added 650 ml. of acetone to prepare a solution (A). This solution was coated on one side of the cellulose triacetate film (I) in a proportion of 25 ml/m² (200 mg/m²) and then dried to obtain an antistatic cellulose triacetate film (II). The specific surface resistivity of the film (I) was more than $1 \times 10^{15}$ Ω under the conditions of 25° C. and 50% RH, while that of the treated surface of the film (II) was $3 \times 10^{8}$Ω under the same conditions as above.

EXAMPLE 3

To a solution of 2 g. of cellulose diacetate in 600 ml. of acetone was added 400 ml. of methanol. Into this solution, 1 g. of silicon dioxide particles of 0.1 to 1 μ in particle size were dispersed to form a dispersion (B). This dispersion was coated on one side of the cellulose triacetate film (I) in a proportion of 20 ml/m² and then dried to obtain a cellulose triacetate film (III) having an inter layer. Subsequently, 1 g. of the exemplified polymer (6) (the polymer produced in Synthesis Example 2) was dissolved in 700 ml. of methanol, and 300 ml. of acetone was added to the resulting solution to prepare a solution (C). This solution was coated on the inter layer of the film (III) in a proportion of 20 ml/m² (20 mg/m²) and then dried to obtain an antistatic cellulose triacetate film (IV). The specific surface resistivity of the treated surface of the film (IV) was $1 \times 10^{11}$Ω under the same conditions as in Example 1, while that of the film (III) was more than $10^{15}$Ω under the said conditions.

EXAMPLE 4

3 Grams of the exemplified polymer (8) (the polymer produced in Synthesis Example 3) and 50 g. of resorcinol were dissolved in 1,000 ml. of methanol to prepare a solution (D). This solution was coated on one side of the polyethylene terephthalate film (V) in a proportion of 15 ml/m² (8 mg/m²) and then dried to obtain an antistatic polyethylene terephthalate film (VI). The specific surface resistivity of the treated surface of the film (VI) was $3 \times 10^{10}$Ω under the same conditions as in Example 3, while that of the film (V) was more than $10^{15}$Ω under the said conditions.

EXAMPLE 5

0.1 Grams of silicon dioxide particles of 0.1 to 1 μ in particle size were dispersed in a mixed solution comprising 400 ml. of acetone and 600 ml. of methanol to prepare a dispersion (E). This dispersion was coated on the treated surface of the antistatic cellulose triacetate film (II) prepared in Example 2 and then dried to obtain an antistatic cellulose triacetate film (VII) having a roughened and non-adherent surface. The antistatic property of the thus obtained film was identical with that of the film (II).

EXAMPLE 6

The solution (C) in Example 3 was incorporated with 0.1 g. of a triethylamine salt of stearyl phosphoric acid ester to prepare a solution (F). This solution was coated, in place of the solution (C) in Example 3, on the inter layer of the cellulose acetate film (III) having an inter layer and then dried to obtain an antistatic cellulose triacetate film (VIII) having a proper lubricity. The antistatic property of the thus obtained film was identical with that of the film (IV).

EXAMPLE 7

A mixture comprising 0.5 g. of the exemplified polymer (6) and 1 g. of poly-1-vinyl-3-methylimidazolium-p-toluenesulfonate was dissolved in 700 ml. of methanol. To the resulting solution was added 300 ml. of acetone to prepare a solution (G). In the same manner as in Example 3, the solution (G) was coated, in place to the solution (C), on the inter layer of the cellulose triacetate film (III) having an inter layer and then dried to obtain an antistatic cellulose triacetate film (IX). The specific surface resistivity of the treated surface of the film (IX) was $3 \times 10^{9}$Ω under the same conditions as in Example 2. On the other hand, 1 g. of poly-1-vinyl-3-methylimidazolium-p-toluenesulfonate was dissolved in 700 ml. of methanol. To the resulting solution was added 300 ml. of acetone to prepare a solution (H). This solution was coated on the inter layer of the film (III) and then dried to obtain a film (X). The specific surface resistivity of the treated surface of the thus obtained film (X) was $1 \times 10^{14}$Ω under the same conditions as above.

EXAMPLE 8

The untreated surfaces of the antistatic films (II), (IV), (VI), (VII), (VIII) and (XI), which were obtained in Examples 2, 3, 4, 5, 6 and 7, one side of each of the films (I), (V) and (X), and the untreated surface of the film (III) were individually subjected to subbing treatment according to an ordinary procedure, coated with a high speed silver halide photographic emulsion and then dried to prepare light-sensitive photographic materials.

These photographic materials were moistened for 24 hours under the conditions of 25° C. and 50% RH, rubbed with a polyvinyl chloride rod under the same conditions as above, and then subjected to ordinary photographic processing to observe the state of formation of static marks. As the result, quite many static marks were observed in the photographic materials having the non-antistatic films (I), (III), (V) and (X) as the supports, whereas no static marks were observed in the photographic materials having the antistatic films (II), (IV), (VI), (VII), (VIII) and (IX) as the supports.

In developing the individual photographic materials, there was used an automatic developing machine having a developer cell of the type that the developer was stirred by introduction of nitrogen gas. As the result, the developer in the cell foamed and flowed out of the cell when each of the photographic materials having the films (I), (III), (V) and (X) as the supports was treated, whereas the developer scarcely foamed and no dregs floated on the developer surface when each of the photographic materials having the films (II), (IV), (VI), (VII), (VIII) and (IX) as the supports was treated. The photographic properties of these individual photographic materials were same, and it was recognized that the polymers used in the antistatic treatments had no detrimental effects on the photographic properties of the photographic materials.

EXAMPLE 9

Both sides of the polyethylene terephthalate film (V) were subjected to subbing treatment according to an ordinary procedure, and a silver halide photographic emulsion and a protective layer-forming gelatin solution were successively coated on each side of the film and then dried to obtain a film (XI) having photosensitive layers on both sides. Subsequently, a solution (I), which had been prepared by dissolving 1.5 g. of the exemplified polymer (12) (the polymer produced in Synthesis Example 5) in 1,000 ml. of methanol, was coated on each side of the film (XI) in a proportion of 12 ml/m² (18 mg/m²) and then dried to obtain a film (XII) having antistatic layers on both sides. The films (XI) and (XII) were individually subjected to light exposure through an X-ray image and then developed to observe the state of formation of static marks. As the result, static marks were observed in the film (XI), whereas no static marks were observed in the film (XII).

What we claim is:

1. A process for the antistatic treatment of a light-sensitive silver halide photographic material, characterized by applying to the photographic material at least one member selected from polymers represented by the general formula,

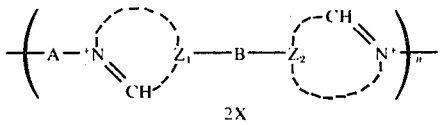

wherein A is an alkylene, alkenylene, arylene, aralkylene or arylenealkylene group having 2 to 18 carbon atoms, or a group of the formula $-R_1COR_2-$, $-R_3COR_4COR_5-$, $-R_6-OR_7)_m$, $-R_8COOR_9OCOR_{10}-$, $-R_{11}OCONHR_{12}NHCOOR_{13}-$ or $-R_{14}CONHR_{15}NHCOR_{16}-$ group; B is a simple bond, or a group selected from $-NHCOR_{17}CONH-$ and A (where $R_1$ to $R_{17}$ are individually an alkylene group having 1 to 10 carbon atoms or a phenylene group, and m is an integer of 1 to 4); $Z_1$ and $Z_2$ are individually a non-metallic atom grouping necessary to form a 5- or 6-membered ring together with the —N=CH—group (or may bond to B in the form of the quaternary salt

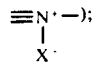

$X^-$ is an anion; and *n* is a positive integer.

2. A process for the antistatic treatment of a light-sensitive silver halide photographic material, as claimed in claim 1, wherein said polymers are those having a —CO— group in the molecule.

3. A process for the antistatic treatment of a light-sensitive silver halide photographic material, as claimed in claim 1, wherein said polymers are those having a specific viscosity ($\eta$ *sp*) of 0.001 to 0.5 when measured as a solution having a concentration of 0.5% of the polymer in 0.5 molar saline water by means of an Ostwald viscometer at a temperature of 25.0° ± 0.2° C.

* * * * *